US006973875B2

(12) United States Patent
Göttling et al.

(10) Patent No.: US 6,973,875 B2
(45) **Date of Patent: *Dec. 13, 2005**

(54) PRINTING MACHINE WITH IMAGE-SETTING DEVICE FOR A ROTARY PRINTING MACHINE

(75) Inventors: Josef Göttling, Friedberg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 664 days.

This patent is subject to a terminal disclaimer.

(21) Appl. No.: 09/792,609

(22) Filed: Feb. 23, 2001

(65) Prior Publication Data

US 2001/0020425 A1 Sep. 13, 2001

(30) Foreign Application Priority Data

Feb. 23, 2000 (DE) ..... 100 08 216

(51) Int. Cl.[7] ..... B41M 5/00

(52) U.S. Cl. ..... 101/463.1; 101/465; 101/467; 101/480

(58) Field of Search ..... 101/463.1, 465, 101/466, 467, 425, 480, 423

(56) References Cited

U.S. PATENT DOCUMENTS 5,103,731 A * 4/1992 Williams et al. ..... 101/467
5,121,688 A * 6/1992 Williams et al. ..... 101/142
5,129,321 A * 7/1992 Fadner ..... 101/467
5,813,336 A * 9/1998 Guaraldi et al. ..... 101/218
5,878,666 A * 3/1999 Schneider et al. ..... 101/217
5,943,956 A * 8/1999 Marquez et al. ..... 101/425
6,085,650 A 7/2000 Petersen ..... 101/220
6,397,743 B1 * 6/2002 Dauer et al. ..... 101/220
6,494,135 B1 12/2002 Göttling et al. ..... 101/213
6,502,509 B2 * 1/2003 Gottling et al. ..... 101/248
2001/0004864 A1 6/2001 Petersen et al. ..... 101/35
2001/0035104 A1 11/2001 Gottling et al. ..... 101/248

FOREIGN PATENT DOCUMENTS

DE 43 37 554 6/1994
DE 197 10 520 9/1998
DE 198 05 898 11/1999
DE 199 37 783 2/2001 ..... B41F 13/20
EP 1 075 943 8/2000 ..... B41F 13/20
GB 2323177 A * 9/1998

* cited by examiner

*Primary Examiner*—Andrew H. Hirshfeld
*Assistant Examiner*—Jill E. Culler
(74) *Attorney, Agent, or Firm*—Cohen, Pontani, Lieberman & Pavane

(57) ABSTRACT

A rotary printing machine having a plurality of printing-unit cylinders mounted one above another on a side wall, their axes lying in a plane inclined with respect to the plane of the printing-material web. An image-setting device is arranged wholly within the range of the obtuse angle which is formed by the plane of inclination of the cylinders and the plane of the printing-material web.

6 Claims, 2 Drawing Sheets

PRINTING MACHINE WITH IMAGE-SETTING DEVICE FOR A ROTARY PRINTING MACHINE

BACKGROUND OF THE INVENTION

1. Field of the Invention

The invention relates to a rotary printing machine having a plurality of printing-unit cylinders mounted on one above another on a sidewall, their axes in a plane inclined with respect to the plane of the printing material web, and image-setting devices arranged adjacent to respective printing cylinders.

2. Description of the Related Art

U.S. Pat. No. 6,494,135 discloses a printing unit for a web-fed rotary printing machine in which a number of printing-unit cylinders are arranged one above another in a plane inclined with respect to the plane of the printing-material web. In one design, the plate cylinders are assigned image-setting devices, which are arranged above and, respectively, below the plate cylinders. In order not to have to increase the overall height of the printing unit for this purpose, the printing-unit cylinders have been arranged to be offset laterally with respect to one another, so that they no longer lie in the same oblique plane. In this design, the printing unit takes up a wider overall space. If image-setting devices were assigned to plate cylinders which, together with the further cylinders, are arranged in a plane inclined with respect to the plane of the printing-material web, the printing unit would be higher.

SUMMARY OF THE INVENTION

The object of the invention is to provide a printing unit with image-setting devices for rotary printing machines which has a compact design and a low overall height.

According to the invention, each image setting device is wholly within an obtuse angle formed by a plane defined by the cylinder axes and the plane of the web of printing material.

The advantageous arrangement of image-setting devices within free, inclined areas which are produced by printing-unit cylinders arranged obliquely one above another in a plane results in a low overall height of the printing unit according to the invention and, overall, a compact design. As a result of this beneficial arrangement, the printing machine can be operated from the plinth level, so that a gallery level can be dispensed with.

The result of offset arrangement of the cylinder guides is advantageous guide conditions on the slides and narrow side walls, which the operating personnel can easily reach through openings which are provided.

An economic printing machine can advantageously be provided by using printing units according to the invention.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
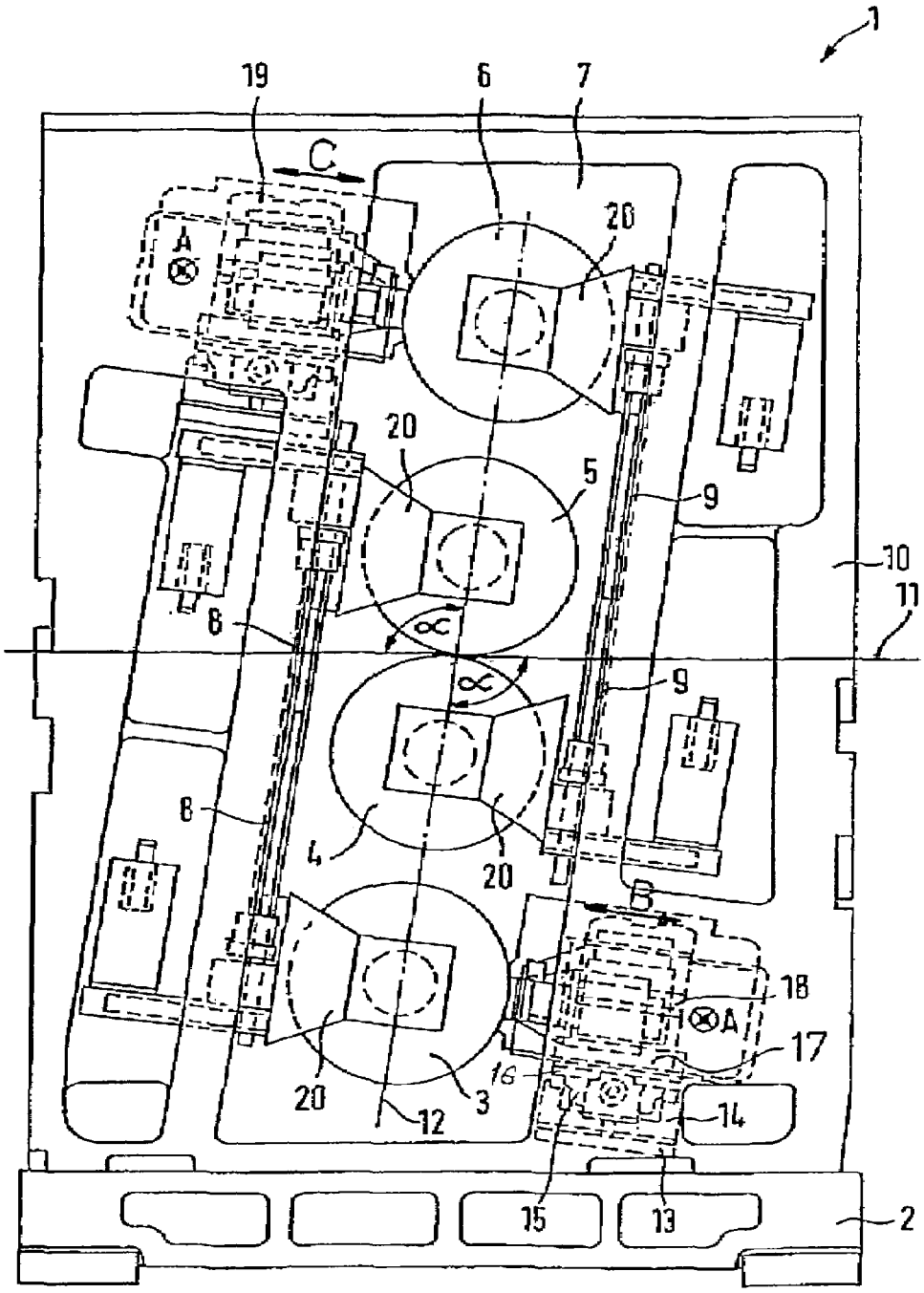
FIG. 1 shows a side view of an exemplary embodiment.

FIG. 1 shows a side wall (10), which is mounted on a base plate (2) and has an opening (7). This printing unit comprises two plate cylinders (3, 6) and two transfer cylinders or rubber covered cylinders (4, 5), which are arranged one above another in a plane of inclination (12) oblique to the vertical at the lateral boundaries of the opening (7). This plane of inclination (12) forms an obtuse angle ($\alpha$) with the running direction of the printing-material web (11), in each case above and below this plane of the printing-material web. The printing-unit cylinders (3, 4, 5, 6) are mounted in bearing units (20) which, in turn, are arranged laterally at the opening (7) on alternate sides, such that they can be displaced and positioned in opposite guides (8, 9) by means of so called cross-slides.

Arranging the cross-slides of the successive printing unit cylinders (3, 4, 5, 6) on alternate sides makes longer slides possible, which results in more beneficial guide conditions at the guides (8, 9), and an advantageous introduction of forces into the side walls (10).

Cross-slides of the type mentioned above are illustrated in U.S. Pat. No. 6,502,509, which is incorporated herein by reference. As a result of these cross-slides, the printing-unit cylinders (3, 4, 5, 6) can be moved and positioned individually both in terms of their distance from one another and in their axial direction.

Within the range of the obtuse angles ($\alpha$) which are formed by the plane of inclination (12) of the cylinders and the plane of the printing-material web, in each case image-setting devices (18, 19) are arranged. These image-setting devices (18, 19) can be moved in the axial direction of the plate cylinders (3, 6) in order to apply the printing image. In this view, the axial direction runs into the plane of the figure, which is indicated by a symbol (A).

This mobility of the image setting devices (18, 19) is permitted by slides (15) which are moved under control in guides (14). The guides (14) are in turn arranged on cross-members (13) that are parallel to the axial direction (A).

The image setting devices (18, 19) can also move towards or away from the cylinders (3, 6) transversely with respect to the axial direction, by which means they can be adapted to different cylinder diameters and can set images on plate cylinders (3, 6) of different formats. For such format adaptations, carriages (17) are provided, which run in guide rails (16) and are arranged on the slides (15). It is therefore possible for the image-setting devices (18, 19) to be moved and positioned under control in the directions of the double arrows (B, C) shown.

The individual components (13, 14, 15, 16, 17) are identified in FIG. 1 only on the lower image-setting device (18), but are also present in identical design on the other image-setting device (19). The inclinations of the image-setting devices (18, 19) with respect to the horizontal plane may differ from each other, so that the directions of motion corresponding to the double arrows (B) and (C) can also differ from each other. In addition, it is also possible to provide only one image-setting device (18, 19) in a printing unit (1) according to the invention.

The printing unit (1) shown by way of example can of course also be assigned further service devices, such as inking units, damping units, washing/erasing devices, fixing stations or else camera systems for checking the image-setting and printing quality. However, illustrating these devices has been omitted for reasons of clarity; their respective arrangement on cross-slides, of the type mentioned at the beginning, is described in U.S. Pat. No. 6,502,509.

Arranging the printing-unit cylinders in the same oblique plane results in identical angular attitudes in relation to each other, and the wrap angle of the printing material web remains unchanged, even in the case of different format diameters. The axial spacing between the various cylinders, to be corrected in the event of a format change, can be controlled in a straightforward manner.

Figure 2:
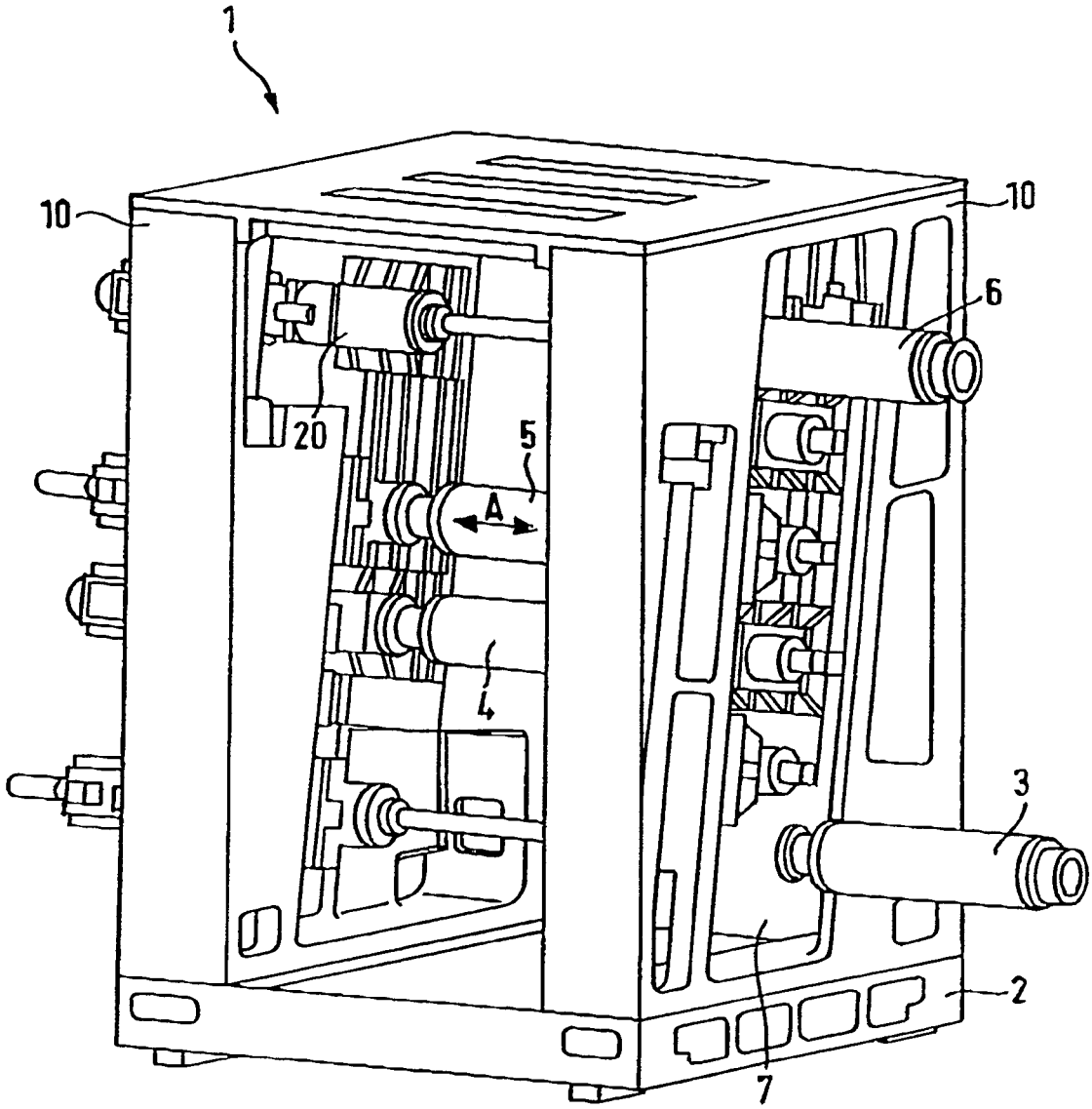
FIG. 2 shows the three-dimensional view of a printing unit according to the invention.

FIG. 2 shows a three-dimensional illustration of a printing unit (1) constructed in accordance with the invention, from which all the parts not relevant here have been removed. It is possible to see side walls (10), which are provided with an opening (7). Within the openings (7), the bearing units (20) arranged on cross-slides are partially visible and, on the rubber-covered cylinder (5), the mobility of the printing-unit cylinders (3, 4, 5, 6) is symbolized by a double arrow (A), by means of which mobility, for example lateral register, can be adjusted.

Using the plate cylinders (3, 6), the illustration shows how, after detaching the couplings to the bearing units (20) and moving the bearing units (20) away, the printing-unit cylinders (3, 4, 5, 6) can be removed through the opening (7) on the operating side of the printing unit (1), and can be replaced by others. For this purpose, it is possible to use transport devices which can be raised and lowered and which, in order to accommodate the printing-unit cylinders (3, 4, 5, 6), are provided, for example, with the same coupling devices as the bearing units (20).

The invention is not limited by the embodiments described above which are presented as examples only but can be modified in various ways within the scope of protection defined by the appended patent claims.

We claim:

1. A rotary printing machine for printing a web of printing material which is fed through the machine in a plane, said machine comprising a side wall;

a plurality of printing unit cylinders mounted on said side wall, said cylinders being arranged one above another and having respective axes which lie in a common plane which is inclined at an obtuse angle to the plane of the web, at least one of said printing unit cylinders lying on each side of the plane of the web; and an image-setting device arranged adjacent to one of the printing unit cylinders and wholly within the obtuse angle.

2. The rotary printing machine of claim 1, further comprising a second side wall, at least one of said side walls having an opening through which said printing unit cylinders can be interchanged.

3. The rotary printing machine of claim 1, further comprising service devices mounted adjacent to respective said cylinders on cross-slides which permit movement of said service devices in two directions relative to the adjacent cylinders.

4. The rotary printing machine of claim 1 wherein said image-setting device is mounted on a cross-slide which permits movement in a direction parallel to the axis of the adjacent said cylinder and in a direction transverse to the axis of the adjacent said cylinder.

5. The rotary printing machine of claim 1, further comprising a second image setting device arranged adjacent to another one of the printing unit cylinders, said image setting devices being arranged on opposite sides of the plane of the web and on opposite sides of the plane of the axes, said second image setting device lying wholly within the obtuse angle.

6. The rotary printing machine of claim 5 wherein said printing unit cylinders comprise two transfer cylinders and two printing plate cylinders, said image setting devices being arranged adjacent to respective said printing plate cylinders.

* * * * *